US010260469B2

(12) United States Patent
Kambakhsh et al.

(10) Patent No.: US 10,260,469 B2
(45) Date of Patent: Apr. 16, 2019

(54) FUEL DISTRIBUTOR RAIL AND METHOD FOR MANUFACTURING SAME

(71) Applicant: TI Automotive (Heidelberg) GmbH, Heidelberg (DE)

(72) Inventors: Manouchehr Kambakhsh, Oakland Township, MI (US); Uwe Fiedler, Allußheim (DE)

(73) Assignee: TI Automotive (Heidelberg) GmbH, Heidelberg (DE)

( * ) Notice: Subject to any disclaimer, the term of this patent is extended or adjusted under 35 U.S.C. 154(b) by 74 days.

(21) Appl. No.: 15/420,432

(22) Filed: Jan. 31, 2017

(65) Prior Publication Data

US 2017/0218903 A1 Aug. 3, 2017

(30) Foreign Application Priority Data

Feb. 1, 2016 (EP) ..... 16153634

(51) Int. Cl.
*F02M 55/00* (2006.01)
*F02M 55/02* (2006.01)
*F02M 61/16* (2006.01)

(52) U.S. Cl.
CPC ..... *F02M 55/025* (2013.01); *F02M 61/168* (2013.01); *F02M 2200/80* (2013.01); *F02M 2200/8069* (2013.01); *F02M 2200/8084* (2013.01)

(58) Field of Classification Search
CPC ..... F02M 55/025; F02M 61/168
See application file for complete search history.

(56) References Cited

U.S. PATENT DOCUMENTS 8,596,246 B2 * 12/2013 Nishizawa ..... F02M 55/025 123/469
2006/0254563 A1 * 11/2006 Keegan ..... F02M 55/02 123/456

(Continued)

FOREIGN PATENT DOCUMENTS

DE 10322769 A1 3/2005
DE 102006010244 B3 9/2007

(Continued)

OTHER PUBLICATIONS

International Search Report for EP 15153534.7 dated Jun. 14, 2016.

*Primary Examiner* — Thomas Moulis
(74) *Attorney, Agent, or Firm* — Brinks Gilson & Lione

(57) ABSTRACT

A fuel distributor rail for a fuel injection system for an internal combustion engine in motor vehicles, in particular for gasoline engines. The fuel distributor rail comprises a main tube, wherein the main tube has a fuel channel extending in the longitudinal direction of the main tube. The main tube comprises at least two outlet openings, wherein the outlet openings branch off the fuel channel. A connecting element is arranged on the main tube, wherein the connecting element has an attachment wall that rests against the main tube. The connecting element is connected to the main tube in a material bonded manner and comprises at least two connecting pieces. The connecting pieces have a connecting channel each for the fluidic connection of an outlet opening to each injection nozzle.

16 Claims, 3 Drawing Sheets

(56) References Cited

U.S. PATENT DOCUMENTS

| | | | | |
|---|---|---|---|---|
| 2009/0144959 | A1* | 6/2009 | Colletti | F02M 55/025 29/428 |
| 2009/0145504 | A1* | 6/2009 | Colletti | F02M 55/025 138/89 |
| 2011/0108005 | A1* | 5/2011 | Nishizawa | F02M 55/025 123/469 |
| 2012/0138020 | A1* | 6/2012 | Kweon | F02M 55/025 123/469 |
| 2013/0047961 | A1* | 2/2013 | Stichlmeir | F02M 55/025 123/446 |
| 2013/0112171 | A1* | 5/2013 | Matsukawa | F02M 55/025 123/456 |
| 2013/0233280 | A1* | 9/2013 | Becker | F02M 55/004 123/470 |
| 2014/0305411 | A1* | 10/2014 | Ikoma | F02M 55/025 123/470 |
| 2015/0176556 | A1* | 6/2015 | Harada | F02M 61/14 123/456 |
| 2015/0369193 | A1* | 12/2015 | Harada | F02M 55/025 123/294 |
| 2016/0273501 | A1* | 9/2016 | Cass | F02M 61/14 |
| 2016/0333840 | A1* | 11/2016 | Horii | F02M 63/028 |

FOREIGN PATENT DOCUMENTS

| | | | |
|---|---|---|---|
| DE | 102009004773 | A1 | 7/2010 |
| JP | 5622826 | B2 | 11/2014 |

* cited by examiner

FUEL DISTRIBUTOR RAIL AND METHOD FOR MANUFACTURING SAME

CROSS REFERENCE TO RELATED APPLICATIONS

The present patent document claims the benefit of priority to European Patent Application No. EP 16153634.7, filed Feb. 1, 2016, the entire contents of which are incorporated herein by reference.

BACKGROUND

The present disclosure relates to a fuel distributor rail for a fuel injection system for internal combustion engines in motor vehicles, in particular for gasoline engines. Furthermore, the present disclosure relates to a method for manufacturing the fuel distributor rail.

Fuel distributor rails for the direct injection of gasoline have basically been known from the prior art. They comprise a tubular element having a fuel channel, from which fuel channel three, four or even more outlet openings usually branch off. The outlet openings are each fluidically connected to an injection nozzle. Moreover, the fuel distributor rail comprises an inlet channel for the supply of fuel to the fuel distributor rail.

In this context, the fluidic connection of the outlet openings to the respective injection nozzle has proven to be expensive. It has thus been known in practice to provide a main tube which forms the fuel channel, and subsequently to create the outlet openings along the main tube by means of drill holes. Individual connecting pieces having one connecting channel each are then connected to these outlet openings, which connecting channel is used to fluidically connect the injection nozzles. According to the prior art known from commercial practice, the main tube as well as the connecting pieces are made of steel.

According to another embodiment known from the prior art, the fuel distributor rail is a forged part. In the manufacturing process, this, however, requires at least one drill hole per connecting piece for manufacturing the connecting channel. Owing to the required minimum length of the connecting pieces, deep drill holes are thus required.

These deep drill holes are expensive, mainly due to the high tolerance requirements regarding position and diameter, which correspondingly makes the manufacturing process more expensive.

SUMMARY

The present disclosure provides a fuel distributor rail for a fuel injection system for internal combustion engines in motor vehicles, in particular for gasoline engines, comprising a main tube, wherein the main tube has a fuel channel extending in the longitudinal direction of the main tube, wherein the main tube comprises at least two outlet openings, wherein the outlet openings branch off the fuel channel, wherein a connecting element is arranged on the main tube, wherein the connecting element has an attachment wall resting against the main tube, wherein the connecting element is connected to the main tube in a material bonded manner, wherein the connecting element has at least two connecting pieces, wherein the connecting pieces respectively have a connecting channel for the fluidic connection of an outlet opening to an injection channel.

The present disclosure is based on the finding that a decoupling of the fuel channel and of the connecting pieces is very advantageous at the beginning of the manufacturing process. The decoupling is accomplished in that the fuel channel is formed by the main tube, and the connecting pieces are only attached to the main tube during a later manufacturing step. The connecting pieces are arranged on the connecting element, which connecting element is attached in a material bonded manner and preferentially by soldering or brazing to the main tube. This decoupling has the advantage that only the outlet openings are at first made by means of drill holes on the main tube. These drill holes must merely pass through the wall thickness of the tube so that a deep drilling process is not required in this case. Consequently, the very high tolerance requirements regarding the position and diameter of the outlet openings are also significantly less expensive. For example, the connecting channels can be made by deep drilling, wherein the connecting channels, however, have a correspondingly larger diameter, so that only low tolerance requirements must be met in this respect. The manufacturing cost is thus significantly reduced.

According to an especially preferred embodiment, the connecting element comprises steel and advantageously austenitic steel. The steel of the connecting element preferentially has an austenitic structural constituent and is advantageously duplex steel. The connecting element and/or the main tube suitably comprises of a steel that is resistant to fuel corrosion. The main tube can have a seamless, or double-walled, or multi-walled configuration.

The connecting element is especially preferentially connected to the main tube in a material bonded manner, and preferably by means of soldering or brazing, especially preferably by means of brazing and very especially preferably by means of high-temperature brazing. It is possible to connect the connecting element to the main tube by means of welding.

According to a preferred embodiment, the connecting element comprises a forged part, and advantageously a die forged part. The connection element suitably has one flash or flashes or deflashed spots. It is preferable that the connecting element is at least mainly and preferentially configured as an entirely integral part. The term "integral" in particular refers to the manufacture in a forged part or in a single cast. According to an especially preferred embodiment, the connecting pieces are integrally connected to the attachment wall. According to another embodiment, the connecting element comprises one, and preferentially only one cast part. The cast part is preferentially made of cast iron.

It is preferred that the connecting element at least encloses the main tube sectionwise longitudinally, and preferably in part along the entire length of the main tube, preferably by a maximum of 350°, preferentially by a maximum of 270°, and especially preferentially by a maximum of 190°. In a special embodiment, the main tube and the connecting element are configured such that, as the connecting element is only partially enclosed, the main tube can be placed into the connecting element. The connecting element very advantageously has two edges, which are parallel to the longitudinal axis of the main tube and, in this case, form an end of the connecting element in the circumferential direction, and which edges preferentially form one part of the attachment wall. It is preferred that both edges extend at least along 50%, or 75%, or 100% of the spread length of the outlet openings. A weld is advantageously arranged along each of the two edges. It is useful that each connecting element respectively has an arched edge on each of its own ends facing the main tubes, along which arched edges a weld is suitably arranged.

It resides within the context of the invention that a longitudinal axis of at least one connecting piece or of a connecting channel intersects the longitudinal axis of the fuel channel. In other words, it is convenient that a longitudinal axis of at least one connecting channel or connecting piece is in one plane with the longitudinal axis of the fuel channel. This condition will be deemed as met if the longitudinal axis of the connecting channel or of the connecting piece passes by the longitudinal axis of the fuel channel by no more than +/−10% of the inner diameter of the main tube. It is especially preferred if the longitudinal axis of the fuel channel and the longitudinal axis of at least one connecting piece, or connecting channel, are in one plane and mutually enclose an essentially right angle.

In accordance with the present disclosure, at least one of the connecting pieces has an inner wall, which inner wall forms the connecting channel, wherein the inner wall is configured integrally with the at least one connecting piece and wherein the inner wall is the innermost wall. It is preferred that the inner wall can be brought into contact with the fuel. The connecting piece suitably has an integral configuration. In particular, the connecting piece is configured such that it does not have an inner sleeve.

In accordance with a preferred embodiment, at least one connecting socket is allocated to at least one connecting piece, which connecting socket is at least sectionwise parallel to the at least one connecting piece. The connecting socket is preferably parallel to the connecting piece along most of its length. The at least one connecting socket is suitably a part of the connecting element and preferably one section of the forged or cast part. The connecting socket is especially preferably configured integrally with the connecting element. It is useful that the connecting piece and the connecting socket at least share a common wall. The end of the at least one connecting socket facing away from the main tube is suitably flush with one end of the connecting piece facing away from the main tube. It is expedient that a longitudinal axis of the connecting socket does not intersect the main tube. It is preferred that one end of the connecting socket facing the main tube is flush with one edge of the connecting element that is parallel to the longitudinal axis of the fuel channel. In practice, the connecting socket has a passage opening along its longitudinal axis.

It is advantageous if the main tube has a wall thickness of at least 1.0 mm, preferably of at least 1.5 mm and especially preferably of at least 2 mm. The wall thickness of the main tube suitably is at most 15 mm, preferentially at most 10 mm and especially preferentially at most 7 mm. The inner diameter of the main tube advantageously is at least 8 mm, preferentially at least 12 mm, and especially preferentially at least 15 mm. The main tube preferably has a maximum inner diameter of 60 mm, preferentially a maximum of 50 mm, and especially preferentially a maximum of 40 mm.

According to a preferred embodiment, the attachment wall has at least one window-like opening. The connecting element suitably has an intermediate area between the at least two connecting pieces. The intermediate area preferentially comprises one part of the attachment wall. The intermediate area is in particular preferably configured like a partial bowl and suitably connects the two connecting pieces. According to a preferred embodiment, the intermediate area comprises at least two window-like openings, wherein the window-like openings are suitably separated from one another by a web.

According to an especially preferred embodiment, at least one of the diameters of the connecting channels is larger than the diameter of the allocated outlet opening by a factor of 1.2, preferably 1.5, and especially preferably 2.0. A diameter of at least one, or of all, outlet openings suitably is at least 1.0 mm, preferably at least 1.5 mm and especially preferably 2.0 mm. At least one, or all, outlet openings suitably have a diameter of at most 20 mm, preferably at most 15 mm and especially preferably at most 10 mm. A suitable diameter of the connecting channels is 4 mm, preferentially at least 6 mm and especially preferentially at least 8 mm. The connecting channels suitably have a maximum diameter of 50 mm, preferably a maximum of 35 mm, and especially preferably a maximum of 25 mm.

It is preferred that the connecting pieces and/or connecting channels only have one longitudinal axis each. It is preferred that none of the connecting channels has a bent or angled configuration. If the connecting sockets or connecting channels only have one longitudinal axis each, any connecting pieces or connecting channels that have a bent or angled configuration are hereby excluded.

It is especially advantageous if the fuel distributor rail is configured such that a maximum pressure of 1,500 bar, preferentially of 1,000 bar, and especially preferentially of 700 bar can be applied thereto. The fuel distributor rail is suitably configured such that it can only be used in gasoline engines. It is preferred that the fuel distributor rail can withstand the pressures commonplace in gasoline engines, but not those that are commonplace in diesel engines.

Furthermore, the subject matter of the present disclosure is a method for manufacturing the fuel distributor rail, in particular a fuel distributor rail according to the present disclosure, wherein a main tube having a fuel channel extending in the longitudinal direction of the main tube is provided, wherein the main tube has at least two outlet openings drilled thereinto, so that the outlet openings branch off the fuel channel, wherein a connecting element is arranged on the main tube such that an attachment wall of the connecting element rests against the main tube, wherein the connecting element is connected to the main tube in a material bonded manner, wherein the connecting element has at least two connecting pieces, wherein each of the connecting pieces has a connecting channel for the fluidic connection of each outlet opening each having an injection nozzle.

According to a preferred embodiment, the connecting element is manufactured by forging and especially preferably by die forging. According to another embodiment, the connecting element is manufactured by casting. The connecting element is especially preferentially connected to the main tube by soldering or brazing. The connecting element is preferentially connected to the main tube by brazing, and especially preferentially by high-temperature brazing. However, the connecting element can also be attached to the main tube by welding.

The invention will be explained in greater detail below with reference to a drawing representing merely one embodiment.

DETAILED DESCRIPTION

Figure 1:
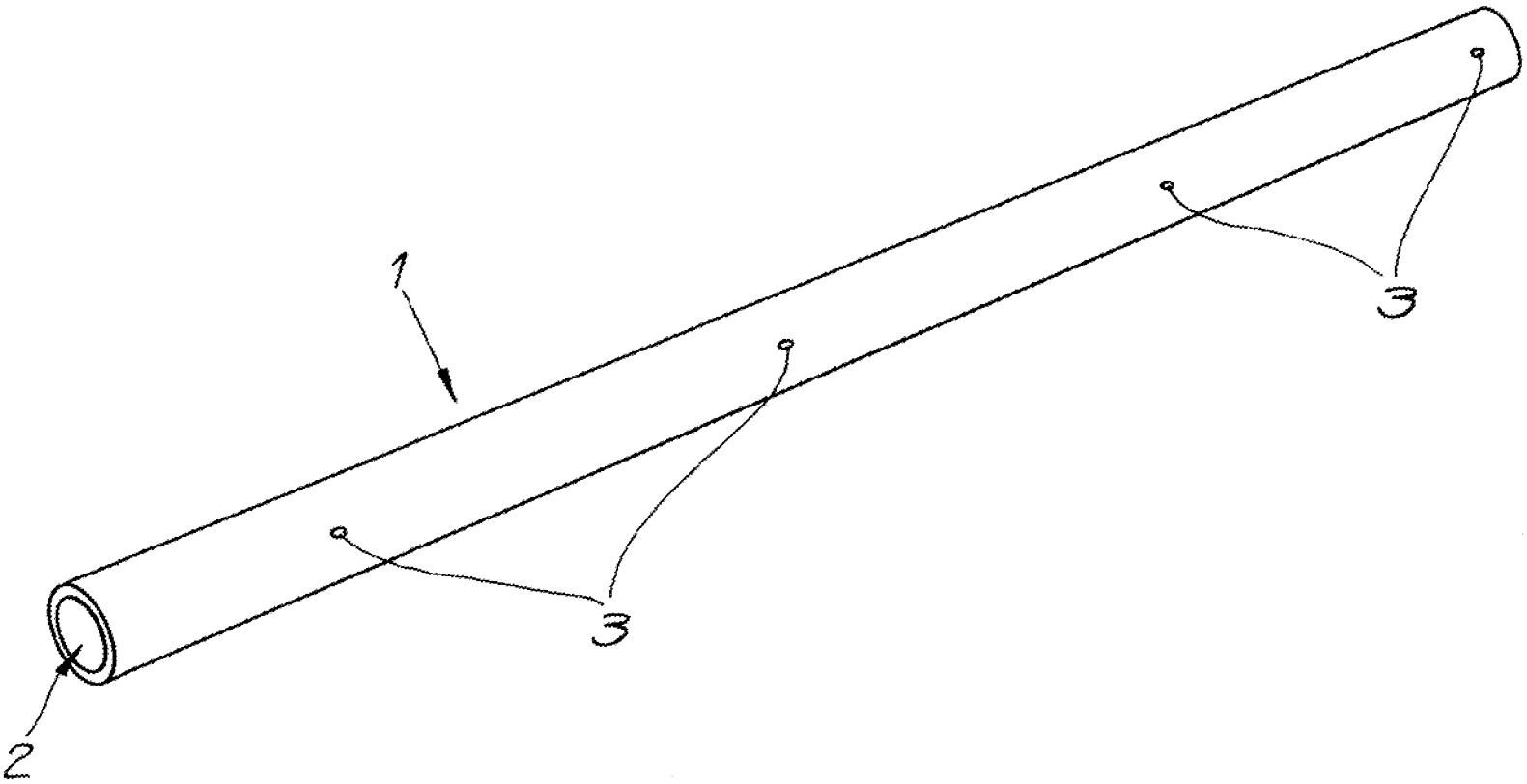
FIG. 1 is a perspective view of a main tube of a fuel distributor rail according to the present invention.

FIG. 1 shows a main tube 1 of a fuel distributor rail according to the present disclosure. The main tube 1 has a fuel channel 2 extending in the longitudinal direction of the main tube. Four outlet openings 3 having a diameter of, for example, 4 mm branch off this fuel channel 2. Owing to the perspective view, it is not evident that there is still another inlet opening on the back side of the main tube 1. The main tube 1 is made of austenitic steel, has a wall thickness of, for example, 3 mm, and an exemplary inner diameter of 20 mm.

Figure 2:
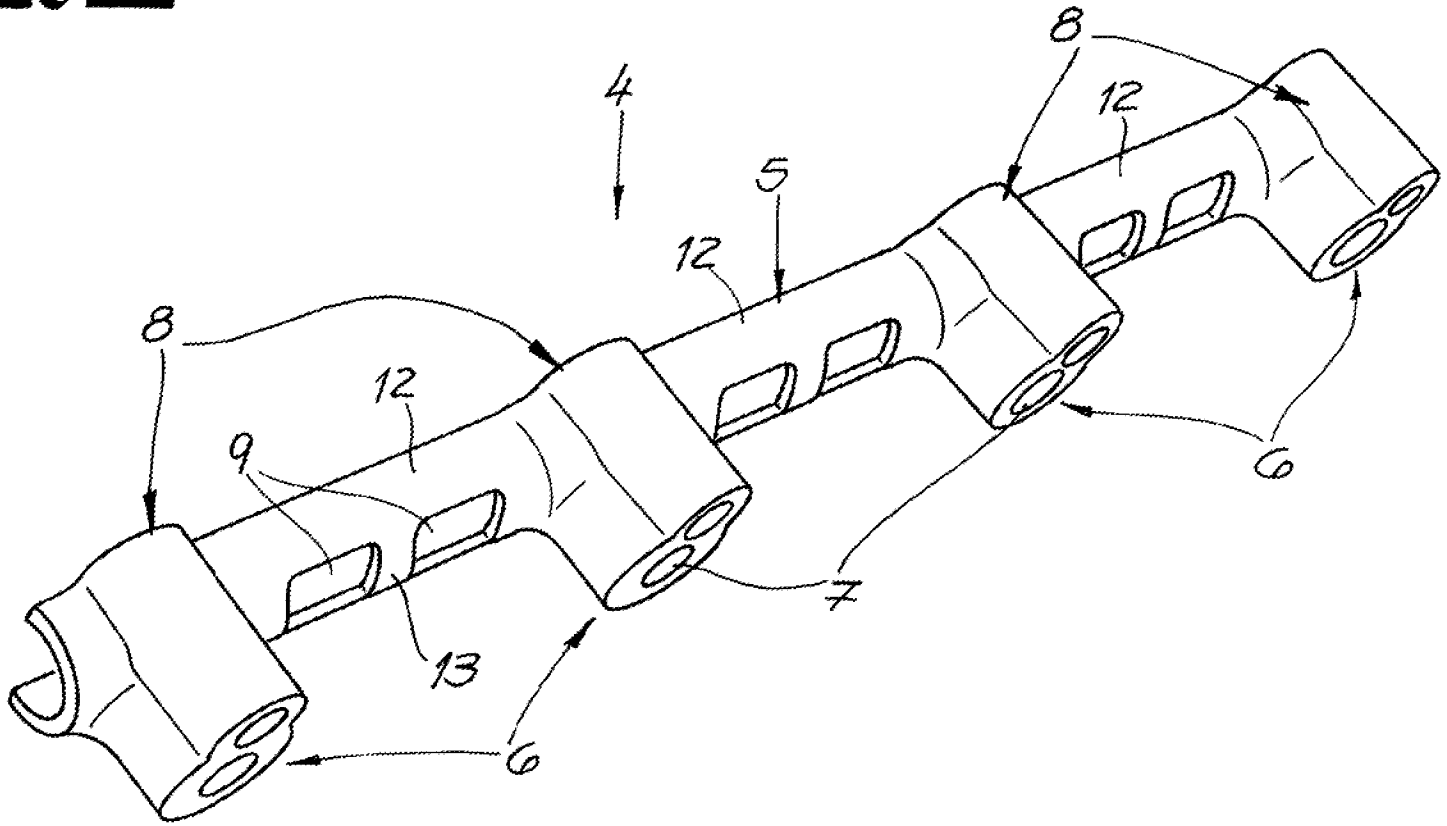
FIG. 2 is a perspective view of a connecting element of the fuel distributor rail.

FIG. 2 shows a connecting element 4 which is placed on the main tube 1 from FIG. 1. In this context, one connecting piece 6 is allocated to each outlet opening 3 of the main tube 1. The connecting pieces 6 fluidically connect the outlet openings 3 and thus the fuel channel 2 to the respective injection nozzles (not shown) via connecting channels 7. A connecting socket 8 is respectively allocated to the connecting pieces 6, wherein the longitudinal axes of the connecting sockets 8 are parallel to the longitudinal axes of the connecting pieces 6. Each connecting socket 8 contacts the connecting piece 6 allocated thereto, so that they share a common wall. An inner diameter of the connecting pieces 6, or a diameter of the connecting channels 7, is for example, 12 mm.

The connecting element 4 is configured such that it can rest against the main tube 1, for which it has an attachment wall 5. In this embodiment, the attachment wall 5 has an intermediate area 12 between each of the four connecting pieces 6, which intermediate area 12 is relatively thin. The thickness of the attachment wall 5 in the intermediate areas 12 is, for example, 3 mm. Furthermore, each of the three intermediate areas 12 has windows 9 which are each separated from one another by a web 13. The connecting element 4 ideally is entirely made of austenitic steel. Thus, the connecting pieces 6 and the connecting sockets 8 are, in particular, also integrally connected to the attachment wall 5. The connecting element of this exemplary embodiment was made by die forging. In a subsequent step, the connecting channels 7 are made by drilling or deep drilling.

Figure 3:
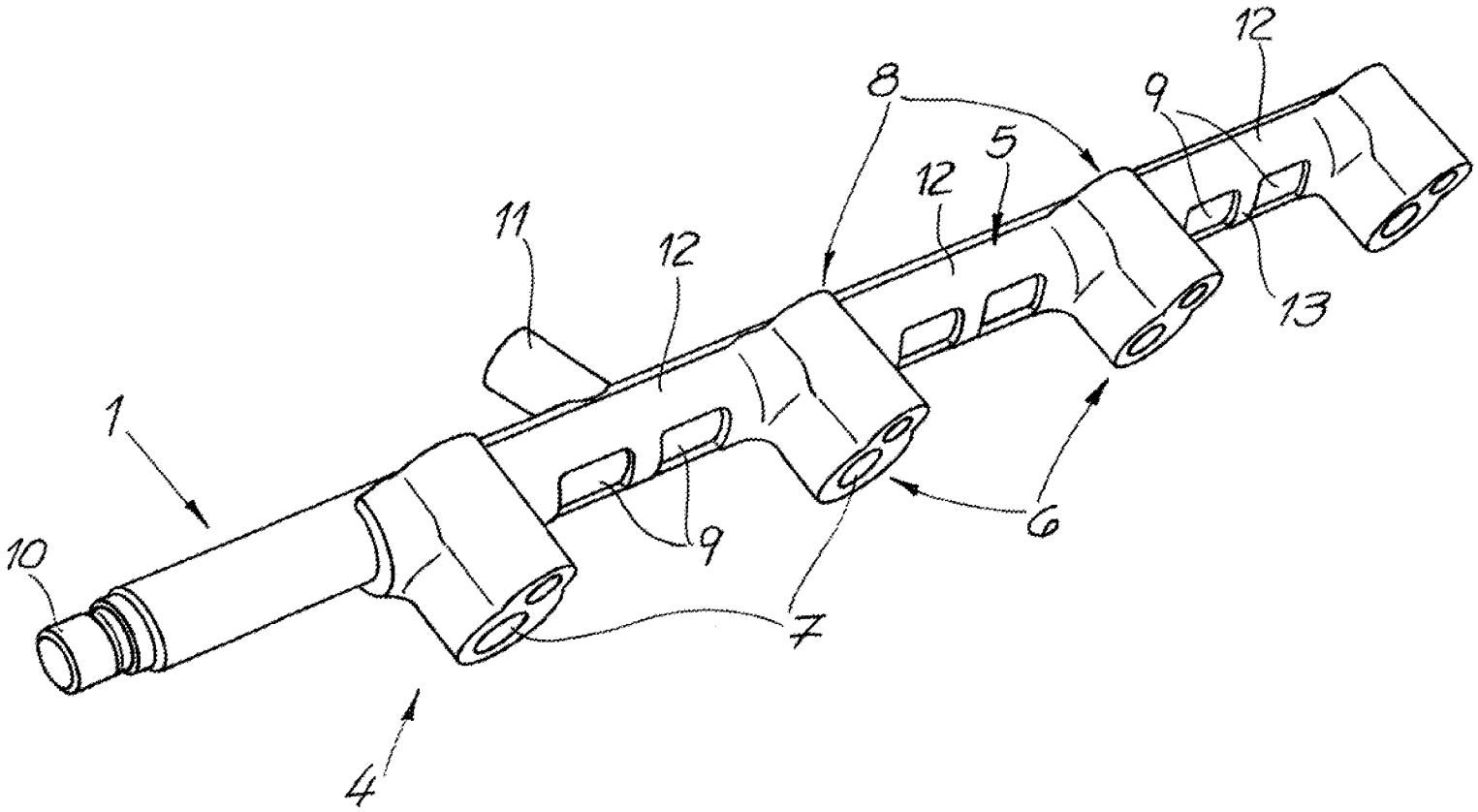
FIG. 3 is a perspective view of the assembled fuel distributor rail, comprising the main tube from FIG. 1 and the connecting element from FIG. 2.

The main tube 1 and the connecting element 4 are joined by brazing. A fuel distributor rail of this kind is shown in FIG. 3. The main tube 1 has been sealed at its ends by means of plugs 10. Moreover, the inlet piece 11 has been brazed onto the main tube 1, such that a fluidic connection of the inlet opening to a fuel line (not shown) is possible.

The invention claimed is:

1. A fuel distributor rail for injecting fuel into internal combustion engines in motor vehicles, comprising a main tube, wherein the main tube comprises a fuel channel extending in the longitudinal direction of the main tube, wherein the main tube comprises at least two outlet openings, wherein the outlet openings branch off the fuel channel, wherein a connecting element is arranged on the main tube, wherein the connecting element has an attachment wall resting against the main tube, wherein the connecting element is connected to the main tube in a material bonded manner, wherein the connecting element has at least two connecting pieces, wherein the connecting pieces each have a connecting channel for the fluidic connection of an outlet opening to an injection nozzle, wherein the connecting element comprises at least two connecting sockets, and wherein the connecting sockets each have an opening passage.

2. A fuel distributor rail according to claim 1, wherein the connecting element comprises steel.

3. A fuel distributor rail according to claim 1, wherein the main tube comprises steel.

4. A fuel distributor rail according to claim 1, wherein the connecting element is attached to the main tube by brazing.

5. A fuel distributor rail according to claim 1, wherein at least a section of the connecting element in longitudinal direction encompasses the main tube only in part in circumferential direction.

6. A fuel distributor rail according to claim 1, wherein a longitudinal axis of at least one connecting piece spans a plane together with the longitudinal axis of a fuel channel.

7. A fuel distributor rail according to claim 1, wherein at least one of the connecting pieces has an inner wall, which inner wall forms the connecting channel, wherein the inner wall is integrally configured with the at least one connecting piece and wherein the inner wall is the innermost wall.

8. A fuel distributor rail according to claim 1, wherein at least one connecting socket is allocated to the connecting piece, wherein at least a section of the connecting socket is parallel to the at least one connecting piece.

9. A fuel distributor rail according to claim 1, wherein the main tube has a wall thickness of at least 1.0 mm.

10. A fuel distributor rail according to claim 1, wherein the connecting element comprises a forged part.

11. A fuel distributor rail according to claim 1, wherein the attachment wall comprises at least one opening.

12. A fuel distributor rail according to claim 1, wherein the inner diameter of one of the connecting channels is at least larger than the diameter of the allocated outlet opening by at least a factor of 1.2.

13. A fuel distributor rail according to claim 1, wherein the connecting pieces or connecting channels only have one longitudinal axis each.

14. A fuel distributor rail according to claim 1, wherein the fuel distributor rail is configured such that a maximum pressure of 1,500 bar can be applied thereto.

15. A method for manufacturing a fuel distributor rail, in particular a fuel distributor rail according to claim 1, wherein a main tube having a fuel channel extending in the longitudinal direction of the main tube is provided, wherein at least two outlet openings are drilled into the main tube, so that the outlet openings branch off the fuel channel, wherein a connecting element is arranged on the main tube, so that an attachment wall of the connecting element rests against the main tube, wherein the connecting element is connected to the main tube in a material bonded manner, wherein the connecting element has at least two connecting pieces, wherein the connecting pieces each have a connecting channel for the fluidic connection of an outlet opening to an injection nozzle, wherein the connecting element comprises at least two connecting sockets, and wherein the connecting sockets each have an opening passage.

16. A method for manufacturing a fuel distributor rail comprising:

providing a main tube having a fuel channel extending in the longitudinal direction of the main tube;

drilling at least two outlet openings into the main tube so that the outlet openings branch off the fuel channel;

arranging a connecting element on the main tube so that an attachment wall of the connecting element rests against the main tube; and connecting the connecting element to the main tube in a material bonded manner, wherein the connecting element has at least two connecting pieces, wherein the connecting pieces each have a connecting channel for the fluidic connection of an outlet opening to an injection nozzle, wherein the connecting element comprises at least two connecting sockets, and wherein the connecting sockets each have an opening passage.

* * * * *